US011879241B1

(12) United States Patent
Eberly

(10) Patent No.: US 11,879,241 B1
(45) Date of Patent: Jan. 23, 2024

(54) DECONTAMINATION RINSE WASTEWATER MANAGEMENT SYSTEM FOR USE WITH A SHOWER FACILITY

(71) Applicant: PARK ENVIRONMENTAL EQUIPMENT, LLC, Houston, TX (US)

(72) Inventor: Christopher Nolan Eberly, Chappell Hill, TX (US)

( * ) Notice: Subject to any disclaimer, the term of this patent is extended or adjusted under 35 U.S.C. 154(b) by 17 days.

(21) Appl. No.: 17/821,586

(22) Filed: Aug. 23, 2022

(51) Int. Cl.
*E03C 1/122* (2006.01)
*E03C 1/126* (2006.01)

(52) U.S. Cl.
CPC ..... *E03C 1/1227* (2013.01); *E03C 1/126* (2013.01)

(58) Field of Classification Search
CPC ..... E03C 1/1227; E03C 1/126
USPC ..... 4/321, 323, 596, 625, 626, 900
See application file for complete search history.

(56) References Cited

U.S. PATENT DOCUMENTS 4,376,702 A * 3/1983 Small ..... E03F 1/006 4/321
5,426,795 A 6/1995 Harty
6,776,175 B2 8/2004 Dunn
8,210,442 B2 * 7/2012 Bondura ..... E03B 1/04 4/626
8,394,274 B2 3/2013 Van Den Berg
9,611,160 B2 4/2017 Underwood
2006/0269439 A1 11/2006 White
2007/0060783 A1 3/2007 Kremnitz
2009/0166280 A1 7/2009 Dong
2010/0237289 A1 9/2010 Self
2011/0163045 A1 7/2011 Mamane
2014/0353256 A1 12/2014 Kaschek

FOREIGN PATENT DOCUMENTS

GB 2515349 A 12/2014

* cited by examiner

*Primary Examiner* — Tuan N Nguyen
(74) *Attorney, Agent, or Firm* — Egbert, McDaniel & Swartz, PLLC

(57) ABSTRACT

A decontamination rinse wastewater management system for use with a shower facility has a containment assembly with a first compartment and a second compartment integrally connected together, and a diverter valve having an inlet, a first outlet and a second outlet. The first outlet is directed to the first compartment. The inlet of the diverter valve is adapted to receive wastewater from the shower facility. The second outlet of the diverter valve is adapted to be connected to a sewer. The diverter valve is actuatable so as to move to a first position wherein wastewater from the shower facility is directed to the first compartment and to move to a second position wherein wastewater from the shower facility is directed to the sewer. The diverter valve is positioned in the second compartment of the containment assembly.

14 Claims, 3 Drawing Sheets

DECONTAMINATION RINSE WASTEWATER MANAGEMENT SYSTEM FOR USE WITH A SHOWER FACILITY

CROSS-REFERENCE TO RELATED APPLICATIONS

Not applicable.

BACKGROUND OF THE INVENTION

1. Field of the Invention

The present invention relates to the treatment of wastewater. More particularly, the present invention relates to the treatment and removal of wastewater from a shower facility. More particularly, the present invention relates to a decontamination rinse wastewater management system in which water from the shower facility is directed to a containment tank or to a sewer depending upon the type of shower activities being conducted in the shower facility.

2. Description of Related Art Including Information Disclosed Under 37 CFR 1.97 and 37 CFR 1.98

Hospital providers around the United States are equipped with patient decontamination shower facilities that potentially generate decontamination wastewater. Patient decontamination is performed when the contaminant poses a further risk to the patient or a secondary risk to response personnel. Contaminants are considered to be hazardous chemical, biological, radioactive, nuclear and explosive substances. Toxic wastewater is potentially generated as a result of the contamination activities. The disposal of toxic wastewater should conform to plumbing codes adopted by cities and municipalities that prohibit such contaminants from entering the public sewer systems.

A traditional design of a decontamination shower system is shown in FIG. 1. As can be seen in FIG. 1, there is a rinse shower room 1 that has a potable shower system (including piping) 2 mounted therein. The rinse shower room 1 can include multiple shower nozzles (as shown in FIG. 1) or can include a single shower nozzle. A floor drain system 3 is positioned at the bottom of the rinse shower room 1. This floor drain system 3 receives water that is released by the potable shower system 2 toward the body of an individual, or other item, that is positioned within the rinse shower room 1. The waste of the floor drain system 3 is connected to a wastewater drain line 4. Wastewater drain line 4 receives water from the floor drain system 3 and passes this water outwardly of the rinse shower room 1. The wastewater drain line 4 extends so as to be connected to a holding tank 5. A line 4*a* extends to pipe clean out. Another line 4*c* extends off of the wastewater drain line 4 so as to release carbon dioxide, and other gases, that may exist within the wastewater drain line 4. A line 4*b* connects to the holding tank 5 so as to allow the wastewater to be drained thereinto. The holding tank 5 is a generally cylindrical body having an interior that contains the wastewater from the rinse shower room 1 therein. The holding tank 5 has a tank level sensor 6. The tank level sensor 6 monitors the level of the wastewater within the interior of the holding tank 5. This tank level sensor 6 is connected by a line 6*a* to a level monitor panel 7 mounted to the side of the rinse shower room 7. A pump-out port 8 extends into the interior of the holding tank 5. Pump-out port 8 allows the wastewater that is accumulated in the interior of the holding tank 5 to be pumped out of the holding tank so as to be disposed of by qualified personnel. The level monitor panel 7 can transmit a signal indicative of an elevated level of wastewater within the holding tank 5. This is initiated by the tank level sensor 6. This allows a suitable warning to personnel to begin the pump-out activities.

This traditional method of managing decontamination wastewater (as shown in FIG. 1) serves to drain the wastewater into an on-property wastewater holding tank. This holding tank has only an inlet pipe 4*b* but no outlet pipe. This holding tank 5 holds a limited amount of wastewater (typically between 500 and 1500 gallons). This holding tank 5 requires periodic wastewater removal by specialized and expensive professional wastewater disposal companies. For this reason, the rinse shower room 1 (or "shower facility") is restricted to for only patient decontamination.

It is estimated that patient decontamination is used for about 1% of the hospital's total operational hours. This results in the decontamination areas being unused approximately 99% of the time. This represents an underutilized asset within the hospital. In an effort to maximize hospital resources, the shower rinse area should be used for non-contamination use. The non-contamination use can include ordinary activities, such as general cleaning of large hospital equipment (e.g. gurneys, wheelchairs, etc.). In order to provide this function, a new design is required. This new design will allow for multiple uses of the shower rinse facility so as to greatly enhance the utilization of the rinse area. It is desirable have a new design that the distinguishes between patient decontamination use and non-decontamination use.

In the past, a decontamination rinse wastewater management system has been employed that utilizes a three-way diverter valve. This allows the drainage flow to go either to the decontamination tank or to the sewer. FIG. 2 shows this traditional decontamination wastewater system with a diverter valve.

As can be seen in FIG. 2, this traditional prior art decontamination wastewater system has a rinse shower room 11 having potable shower systems (including piping and valves) 12 therein. A floor drain system 13 (as similar to that shown in FIG. 1) is located at the bottom of the rinse shower room 11. The wastewater drain line 14 extends from the floor drain system 13 outwardly of the rinse shower room 11. This wastewater drain line 14 has a divergent portion 14*c* that allows carbon dioxide and other gases to be released therefrom. Line 14*b* extends to pipe clean out. Another portion 14*b* extends to an interior of a dry vault compartment 10. A three-way diverter valve 11 is positioned on the interior of the vault compartment 10. Portion 14*b* of wastewater drain line 14 connects to an inlet of this three-way diverter valve 11. The three-way diverter valve 11 includes an actuator that allows the diverter valve to be directed to various outlets. Outlet 11*a* allows wastewater to pass into the interior of a holding tank 15. Outlet 11*b* allows the wastewater to pass to the sewer. An electrical junction box 13 is mounted to the top of the vault compartment 10 and then connected to the three-way diverter valve 11. The electrical junction box 13 is also connected to a diverter valve control panel 18 positioned on the rinse shower room 11. A sump pump 12 is positioned interior of the vault compartment 10. Sump pump 12 serves to remove any liquids that might accumulate in the dry vault compartment 10 and then pass such liquids outwardly therefrom into the outlet line 11 a extending from the diverter valve 11. As such, any liquids on the interior of the vault compartment 10, along with liquids flowing from the portion 14*b* of the wastewater drain line 14 can flow into the interior of the holding tank 15.

The holding tank 15 includes a tank level sensor 16 that is adapted to sense a level of wastewater within the holding tank 15. A pump-out port 19 extends into the interior of the holding tank 15 so as to allow for the removal of the wastewater from the interior of the holding tank 15. Another electrical junction box 13 is positioned at the top of the holding tank 15 and is connected by an electrical line 13*a* to a tank level monitor panel 17 mounted on the rinse shower room 11.

This wastewater diversion method is currently gaining acceptance in the hospital industry. However, this requires a complicated design and installation of many components. The system is quite expensive. As such, new design is required so as to provide a simplified, economical and pre-engineered system.

In the past, various patents and patent application publications have issued with respect to the treatment of contaminations in the hospital environment. For example, U.S. Pat. No. 5,426,795, issued on Jun. 27, 1995 to R. D. Harty, describes a device for decontaminating persons contaminated with hazardous materials. This patent describes a contamination control device which comprises a recessed patient bearing surface having a first end and a second end. A catch basin is integrally attached to the second end of the patient bearing surface so as to isolate and store contaminated cleaning fluid and bodily fluid. There is an enclosed conduit that directs the contaminated fluid and bodily fluid from the patient bearing surface to the catch basin.

U.S. Pat. No. 6,776,175, issued on Aug. 17, 2004 to Dunn et al., shows a liquid waste disposal and canister flushing system for a medical canister. This liquid waste disposal system includes a press-fit canister lid and features a cabinet with an opening and a sink with a drain positioned therein. A mounting bracket is affixed to the cabinet and includes a shaft connected to the canister bracket for rotating the canister and a shaft connected to the lid removal bracket for removing the canister lid from the canister. The canister is secured within the canister bracket and is rotated from an initial position to a drainage position. The canister lid is positioned on the removal bracket and is rotated from an initial position to a removal position. Once the canister is rotated into the drainage position, the pressurized and diluted cleaning solution source is activated to flush the contents out of the canister and into the sink and drain.

U.S. Pat. No. 8,394,274, issued on Mar. 12, 2013 to E. A. Van Den Berg, describes a method and system for treating different waste streams. The waste is presented in containers, such as chamber pots and other containers for liquid and other kinds of waste. In a separating stage, the waste stream is separated into container material and actual waste. Actual waste is fed to a bioreactor where the water is purified so that it may be used, if desired. If biodegradable, the container material may be subjected to a fermentation step. Heat and gases released in the process may be used for heating the fermenter and/or generating power. The stream leaving the fermentation may be separated into hard components which are filtered off and composted.

U.S. Pat. No. 9,611,160, issued on Apr. 4, 2017 to Underwood et al., shows a clinical analyzer wastewater treatment apparatus having a carbonator section. There is also an anodic oxidation section and a UV oxidation section. There is also a heavy metal removal section. The anodic oxidation section includes a conductive diamond anode. There is a measurement device downstream of the carbonator section and a control system to control the operation of the carbonator.

U.S. Patent Application Publication No. 2006/0269439, published on Nov. 30, 2006 to J. M. White, discloses a biological fluid treatment and disposal apparatus. This is an apparatus for treating and disposing of liquid waste from a waste container having a motive and carrier liquid flow passageway including a first Venturi, a liquid waste flow passageway, including a mixing chamber, connected to the first Venturi so as to impose a suction and draw waste from a waste container through the liquid waste flow passageway when the motive and carrier liquid is flowing through the first Venturi. A disinfectant line is connected between a source of liquid disinfectant and the mixing chamber so as to impose a suction and automatically draw liquid disinfectant through the disinfectant line to mix with the liquid waste when liquid waste is flowing through the mixing chamber.

U.S. Patent Application Publication No. 2007/0060783, published on Mar. 15, 2007 to H. W. Kremnitz, teaches a process for the treatment of unwanted toxic hazardous and infectious leftovers generated by clinics, hospitals and pharmaceutical/biochemical industries. This process includes basic reaction steps such as sterilization, remediation, neutralization and oxidation, in combination with a three-step polymerization for volume reduction and reagent attachable surface increase.

U.S. Patent Application Publication No. 2009/0166280, published on Jul. 2, 2009 to Y. Dong, provides a wastewater purifying system for hospitals. This wastewater purifying system has interconnected grills, a regulating disinfection pool, a coagulation pool, a preliminary settling tank, a hydrolysis-acidification pool, and aerobic bio-filter, a secondary settling tank, an advanced oxidation device, a sludge pool, and a recycling impounding reservoir. The regulating disinfection pool is used to accumulate original wastewater released from every source. The advanced oxidation device is used to oxidizer remaining organic matters into inorganic molecules via chemical and biochemical methods or via physical methods.

U.S. Patent Application Publication No. 2010/0237289, published on Sep. 23, 2010 to Self et al., provides an infectious waste treatment system wherein waste material is reduced and rendered to be decontaminated and unrecognizable. This treatment system is utilized for thermomechanically treating and processing all types of waste material. The treatment system includes a container processing unit in communication with a disinfection unit. The container processing unit is used to receive the waste materials in containerized form and convert the waste material into a usable medium for the disinfection unit. The disinfection unit comprises a system which drives a thermal mechanical process wherein the waste material is rendered decontaminated and unrecognizable.

U.S. Patent Application Publication No. 2011/0163045, published on Jul. 7, 2011 to Mamane et al., shows a method and system for treating contaminated water. The methods and systems are based on identifying one or more contaminants in the contaminated water and identifying an optimal pH for performing direct photodegradation of the contaminants.

U.S. Patent Application Publication No. 2014/0353256, published on Dec. 4, 2014 to Kaschek et al., teaches a multi-barrier system for water treatment. The multi-barrier system includes an enclosed containment that comprises a first water container, an adjustable ozonation unit, a second water container, and a UV unit. The first water container comprises an ozone-resistant filtration unit.

United Kingdom Patent Application Serial No. 2515349, published on Dec. 24, 2014, teaches a clinical fluid waste disposal and segregation system. This segregation system comprises an inlet for receiving effluent waste, a segregating means in the form of a filter for separating clinical waste from effluent, and an outlet for releasing the remainder of the effluent. The system includes a pump and a macerator. The system further includes an ultraviolet disinfection unit and a power supply unit. In use, the clinical waste effluent is received by the system inlet either from a direct feed or from a suction canister and is then passed through a filter with the filtered waste fluid being sent to the sewage system.

It is an object of the present invention to provide a decontamination rinse wastewater management system that reduces toxic wastewater released into the environment.

It is another object to the present invention to provide a decontamination rinse wastewater management system that avoids periodic wastewater removal by specialized and expensive professional waste disposal companies.

It is another object of the present invention to provide a decontamination rinse wastewater management system that allow shower facilities to have uses other than for decontamination.

It is another object of the present invention to provide a decontamination rinse wastewater management system that maximizes the use of decontamination areas in the hospital environment.

It is another object of the present invention to provide a decontamination rinse wastewater management system that makes better use of hospital assets.

It is another object of the present invention to provide a decontamination rinse wastewater management system that allow shower facilities to be used for non-decontamination, such as cleaning of hospital equipment.

It is a further object to the present invention to provide a decontamination rinse wastewater management system that avoids complicated configurations.

It is another object of the present invention to provide a decontamination rinse wastewater management system that minimizes the number of components that are required by the system.

It is another object of the present invention to provide a decontamination rinse wastewater management system that is simple, economical and pre-engineered.

It is another object of the present invention to provide a decontamination rinse wastewater management system that is eco-friendly and sustainable.

It is a further object of the present invention to provide a decontamination rinse wastewater management system that provides for the safe containment of contaminated wastewater.

It is another object of the present invention to provide a decontamination rinse wastewater management system that protects sewer systems and building occupants.

It is a further object of the present invention to provide a decontamination rinse wastewater management system that intercepts and stored wastewater discharged from the contamination rinse showers.

It is a further object of the present invention to provide a decontamination rinse wastewater management system that prevents hazardous substances from entering the public sewer systems.

It is another object of the present invention to provide a decontamination rinse wastewater management system that is a unified system.

It is another object of the present invention to provide a decontamination rinse wastewater management system that has a compact footprint.

It is another object of the present invention to provide a decontamination rinse wastewater management system that is easy to install.

It is still another object of the present invention to provide a decontamination rinse wastewater management system that allows the components to be obtain from a single source, rather than multiple sources.

It is a further object to the present invention to provide a decontamination rinse wastewater management system that reduces freight cost.

It is still another object of the present invention to provide a decontamination rinse wastewater management system that has non-porous surfaces for easy cleaning These and other objects and advantages of the present invention will become apparent from a reading of the attached specification and appended claims.

BRIEF SUMMARY OF THE INVENTION

The present invention is a decontamination rinse wastewater management system for use with a shower facility. This decontamination rinse wastewater management system has a containment assembly with a first compartment and a second compartment, and a diverter valve. The diverter valve has an inlet, a first outlet and a second outlet. The first outlet is directed to the first compartment. The inlet of the diverter valve is adapted to receive wastewater from the shower facility. The second outlet of the diverter valve is adapted to be connected to a sewer. The diverter valve is actuatable so as to move to the first position wherein wastewater from the shower facility is directed to the first compartment and moved to a second position wherein water from the shower facility is directed to the sewer. The diverter valve is positioned in the second compartment. A controller is connected to the diverter valve so as to move the diverter valve between the first and second positions.

In the containment assembly of the present invention, the first compartment and the second compartment are integrally connected together as a single unit. In one embodiment, the first compartment has a single wall extending in a generally cylindrical configuration. The first outlet extends through the single wall into an interior of the first compartment. In an alternative embodiment, the first compartment is of a double-wall construction in which an inner wall is positioned in an interior of an outer wall so as to define an annulus therebetween. A leak detector is positioned in the annulus between the inner wall and the outer wall. The leak detector is adapted to sense a presence of a liquid in the annulus.

The diverter valve comprises a valve body, a first pipe connected to the valve body and extending in a direction toward the shower facility, a second pipe connected to the valve body and extending outwardly of the second compartment, and a third pipe connected to the valve body and extending outwardly of the second compartment and into the first compartment. The first pipe is the inlet of the diverter valve or connected to the inlet of the diverter valve. The second pipe is adapted to be connected to the sewer. The third pipe is adapted to discharge rinse water into the first compartment.

The containment assembly is formed of a material selected from the group consisting of fiberglass, steel and concrete. The first compartment has a first riser extending from an upper portion thereof. The second compartment has a second riser extending from an upper portion thereof Each of the first and second risers is adapted to allow access to an interior of the first and second compartments, respectively. The second compartment has a sump pump on an interior thereof. The sump pump is connected to the second pipe. The sump pump is adapted to pump a liquid in the second compartment toward the sewer.

The decontamination rinse wastewater management system of the present invention further includes a level sensor affixed within the first compartment. The level sensor is adapted to detect a level of the wastewater in an interior of the first compartment. A water sensor is positioned in an interior of the second compartment. The water sensor is adapted to sense a presence of water in the second compartment. An electrical junction box is connected to the leak detector, the level sensor and the water sensor. The electrical junction box is in communication with the controller. As such, the controller can control the action of the diverter valve dependent upon those sensed inputs from the leak detector, the level sensor and the water sensor.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
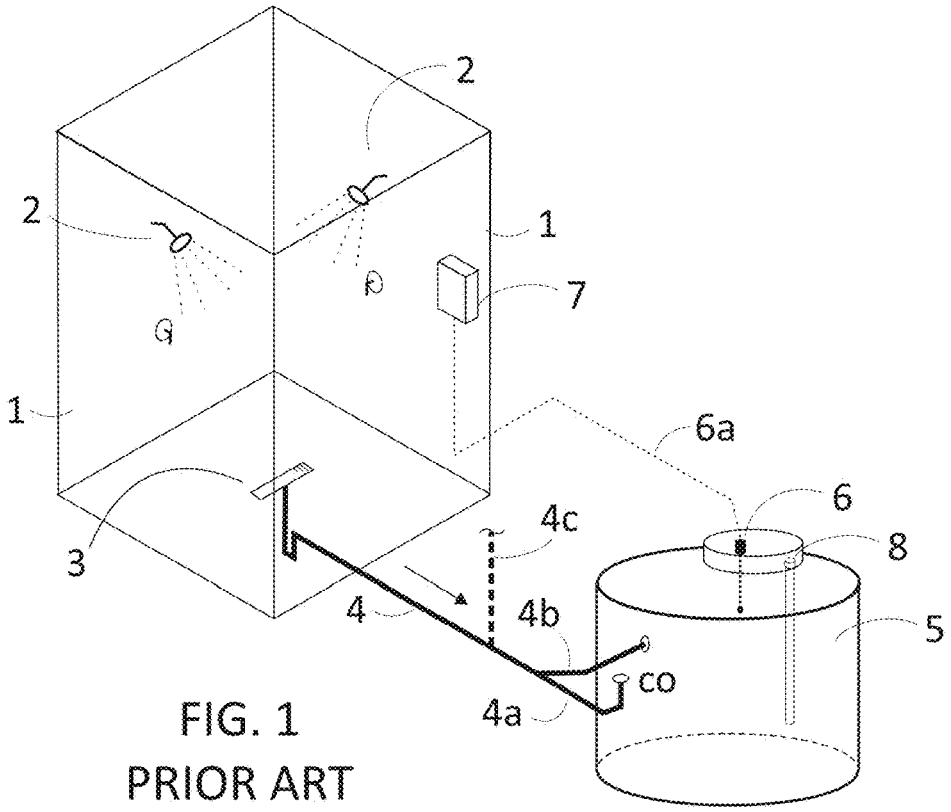
FIG. 1 PRIOR ART
FIG. 1 is a diagrammatic illustration of a prior art decontamination rinse system.
Figure 2:
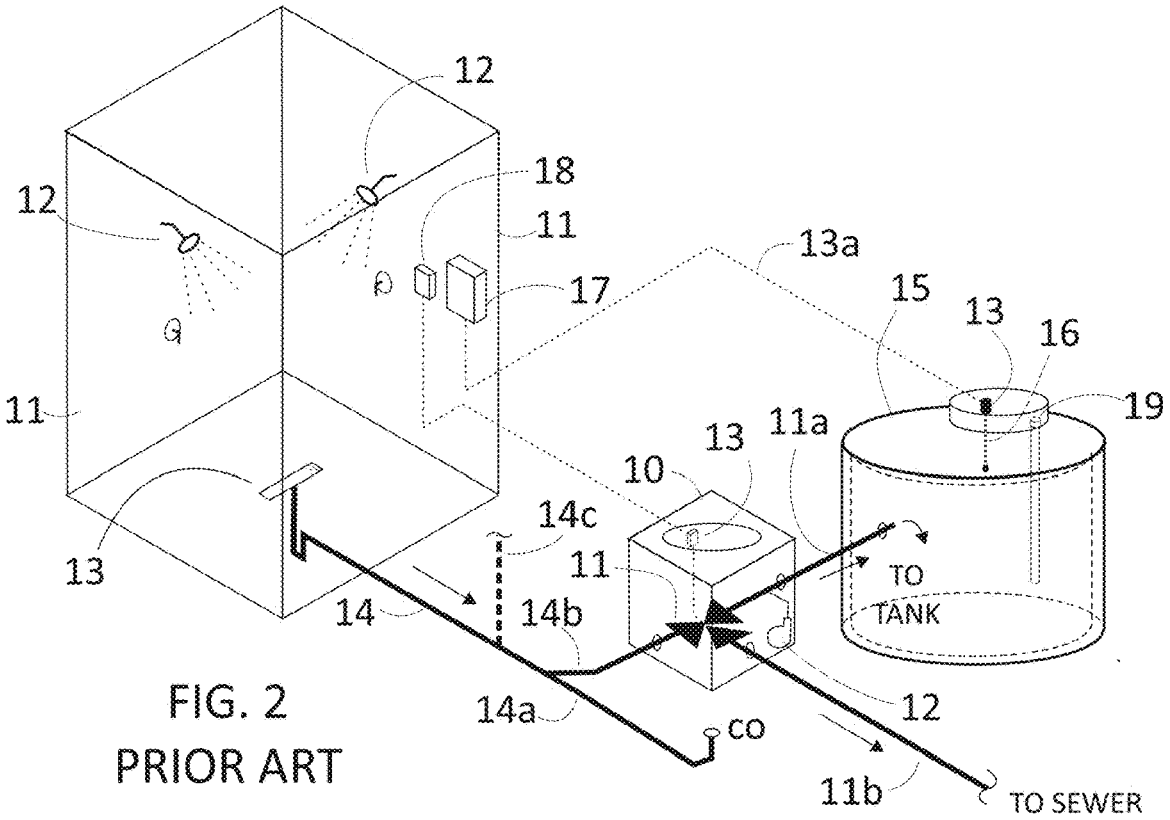
FIG. 2 PRIOR ART
FIG. 2 is a diagrammatic illustration of another prior art decontamination rinse system.
Figure 3:
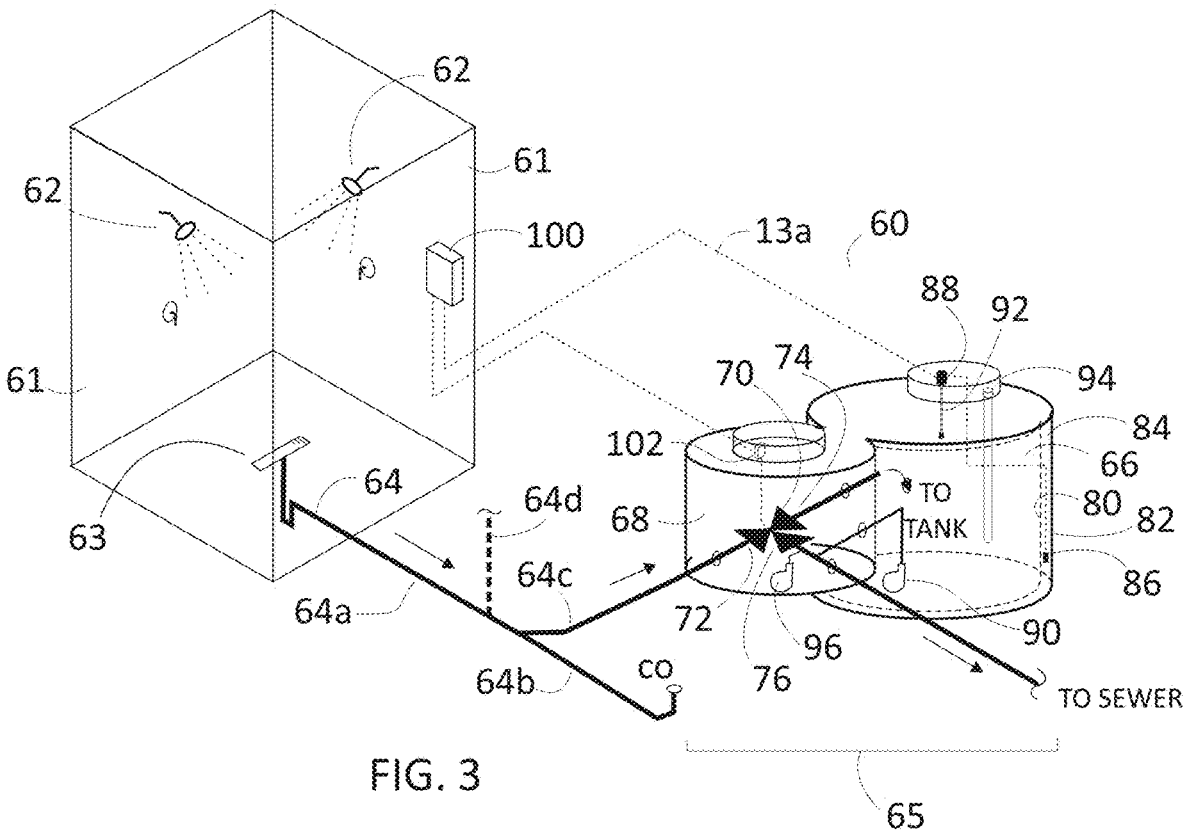
FIG. 3 is a diagrammatic illustration of the decontamination rinse wastewater management system of the present invention.

Referring to FIG. 3, there is shown the decontamination rinse wastewater management system 60 in accordance with the teachings of the present invention. This decontamination rinse wastewater management system 60 has many features in common with the previous embodiments, as shown in FIGS. 1 and 2. In particular, the decontamination rinse wastewater management system 60 includes a rinse shower room 61 having a potable shower system 62 positioned in an interior thereof. A floor drain system 63 is located at the bottom of the rinse shower room 61. A wastewater drain line 64 opens to the floor drain system 63 and extends so as to allow the wastewater from the rinse shower room 61 to be transferred out of the rinse shower room 61 toward the decontamination rinse wastewater management system 60.

As can be seen, the wastewater drain line 64 includes a conduit 64*a* that extends outwardly of the rinse shower room 61. Conduit 64*a* includes a portion 64*d* that allows gases to escape from the wastewater drain line 64. Portion 64*b* extends to pipe clean out. The actual wastewater will flow on conduit portion 64*c* toward a containment assembly 65. The containment assembly 65 includes a first compartment 66 and a second compartment 68. A diverter valve 70 has an inlet 72 that is connected to the conduit portion 64*c* of the wastewater drain line 64. The diverter valve 70 has a first outlet 74 directed to the first compartment 66. The diverter valve 70 also has a second outlet 76 that is adapted to extend to a sewer. The diverter valve 70 is actuatable so as to move to a first position wherein the wastewater from the rinse shower room 61 and the potable shower system 62 is directed to the first compartment 66 and moved to a second position when the wastewater from the rinse shower room 61 is directed to the sewer. The diverter valve 70 is positioned within the interior of the second compartment 68.

The first compartment 66 is considered to be a wet compartment. The second compartment 68 is considered to be a "dry" compartment.

In FIG. 3, it can be seen that the containment assembly (including the first compartment 66 and the second compartment 68) are integrally connected together. As such, since these compartments 66 and 68 are integrally connected together, the containment assembly 65 can be shipped and deployed as a single unit. The present invention avoids the need for separate components to be developed, installed, and linked together. The containment assembly 65 can be manufactured and shipped with the diverter valve 70 already installed within the second compartment 68. The inlet 72 of the diverter valve 70 can be installed as a pipe extending outwardly of the second compartment 68. The first pipe 74 can be preinstalled as extending through the second compartment 68 and extending through an opening in the wall of the first compartment 66 such that the second pipe associated with the diverter valve 70 opens to the interior of the first compartment 66. Similarly, a third pipe associated with the second outlet 76 of the diverter valve 70 can be preinstalled so as to extend outwardly of the second compartment 68 and ultimately extend so as to connect to a sewer. When the diverter valve 70 is in the first position, the wastewater from the rinse shower room 61 will flow through the wastewater drain line 64, through the first pipe associated with the inlet 72, through the diverter valve 70 and ultimately drain into the first compartment 66. When the diverter valve 70 is moved to the second position, any wastewater flowing from the rinse shower room 61 through the floor drain system 63 and the wastewater drain line 64 will be diverted so as to flow outwardly to the sewer.

In FIG. 3, it can be seen that the first compartment 66 can be either of a single wall construction in the form of a cylinder or it can be a double-wall construction. The double wall construction has an inner wall 80 and an outer wall 82. The space between the inner wall 80 and the outer wall 82 defines an annulus 84. A leak detector 86 is positioned in the annulus 84. Leak detector 86 determines if there is a leakage through the inner wall 80 into the annulus 84. Ultimately, this leak detector 86 can be connected to an electrical junction box 88. A sump pump 90 is located near the bottom of the first compartment 66. Sump pump 90 serves to pump liquids residing on the interior of the first compartment 66 to the sewer if the contents are determined to be free of contaminants.

First compartment 66 further includes a tank level sensor 92 and a pump-out port 94. Tank level sensor 92 detects the level of liquid within the interior of the first compartment 66. The pump-out port 94 allows contaminated material within the interior of the first compartment 66 to be removed by specialized personnel.

The second compartment 68 has the diverter valve 70 positioned therein. A sump pump 96 is positioned at the bottom of the second compartment 68. Sump pump 96 serves to pass any liquids that might reside at the bottom of the second compartment 68 outwardly to the pipe associated with the second outlet 76 of the diverter valve 70 and ultimately passed toward the sewer.

A controller 100 is illustrated as mounted to the rinse shower room 61. Controller 100 can also be located any other convenient location. Controller 100 is connected by suitable communication lines (electrical, optical, or transmitter/receiver) to the electrical junction box 88 on the first compartment 66 and to an electrical junction box 102 on the second compartment 68. As such, the necessary information pertaining to the status of conditions within the first compartment 66 and the second compartment 68 can be communicated to users of the rinse shower room 61.

Figure 4:
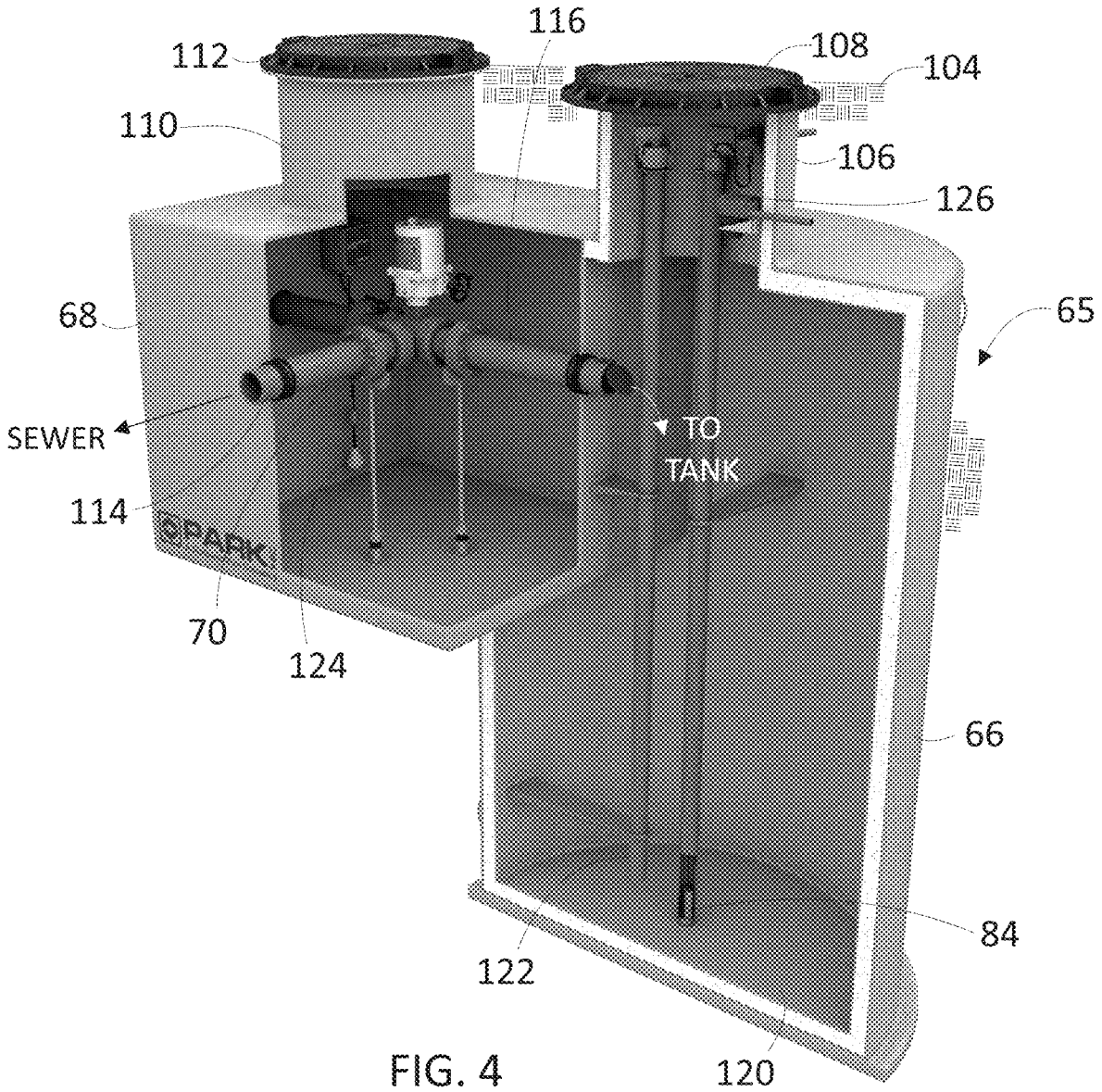
FIG. 4 is a partial cutaway view of the containment assembly as used in the decontamination rinse wastewater management system of the present invention.

FIG. 4 illustrates the configuration of the containment assembly 65. It can be seen that the containment assembly 65 is buried within the earth 104. The first compartment 66 is illustrated as connected to the second compartment 68. The first compartment 66 includes a riser 106 that extends upwardly so as to have a cover 108 opening slightly above the ground surface 104. The second compartment 68 also includes a riser 110 at the top thereof Riser 110 extends upwardly so as to open slightly above the ground surface 104. A cover 112 extends over the second riser 110 associated with the second compartment 68.

FIG. 4 shows the diverter valve 70 as positioned within the second compartment 68. The diverter valve 70 includes a pipe 114 that extends to the sewer. Pipe 116 extends to the first compartment 66 and opens to the first compartment 66. Another pipe extending from the diverter valve 70 will extend to the conduit portion 64*c* associated with the wastewater drain line 64. Each of the risers 106 and 110 allow access to the interior of the separate compartment 66 and 68.

FIG. 4 shows the first compartment 66 and second compartment 68 as being of a heavy-duty fiberglass structure. Within the concept of the present invention, the first compartment 66 and the second compartment 68 can also be of a steel or concrete construction. The leak detection sensor 84 is illustrated as positioned adjacent to the bottom 120 of the first compartment 66. The line from the leak detection sensor 84 extends through a pipe to the top of the first compartment 66. A suction port 122 also extends downwardly so as to open adjacent to the bottom 120 of the first compartment 66. Suction port 122 allows any waste materials within the interior of the first compartment 66 to be removed therefrom by qualified personnel. A level sensor 124 is shown as positioned within the interior of the second compartment 68. Level sensor 124 will be indicative of the accumulation of liquid within the interior of the second compartment 68. An ultrasonic level sensor 126 is positioned on the interior of the first compartment 66. Ultrasonic level sensor 126 determines the level of liquid within the first compartment 66. If the level of liquid within the first compartment 66 is too high, it will be time for qualified personnel to be called in order to effectively remove the waste material from the interior of the first compartment 66.

The present invention is a practical use of decontamination rinse facilities in order to enhance the utilization of such facilities in an eco-friendly and sustainable manner. The present invention includes a wastewater holding tank system for the containment of contaminated wastewater. The system is engineered to protect sewer systems and building occupants by intercepting and storing hazardous wastewater discharged from patient decontamination rinse showers, rinsing activities or biohazard isolation activities. The present invention prevents hazardous substances from entering the public sewer system. The present invention is engineered to protect sewer systems and building occupants by intercepting and storing hazardous waste pool water discharged from decontamination rinse showers and rinsing activities.

The present invention provides a "unified system" having multiple compartments and including a wet compartment and a dry compartment. The wet compartment serves as the containment tank and provides for storage of the decontamination wastewater. The dry compartment houses a three-way diverter valve and associated piping. The containment tank can be provided with a single wall or a double wall. The double-wall design provides secondary containment in the case of a leak of the primary tank. The double-wall construction also allows for leak detection.

The dry compartment serves as the valve vault and will house the diverter valve and associated piping. The diverter valve is an innovative feature that allows for greater utilization by hospital facilities. Hospital personnel can direct the wastewater discharged either the sanitary sewer (for general purpose rinsing) or to the containment tank for patient decontamination rinse activities. The present invention includes a management control system that allows the facility to monitor water level, leak detection, diversion valve control, and enable tank contents to be pumped into the sewer. The system will allow ultimate user management and maximum medical facility utilization. The system includes clean-out ports for the emptying and disposal of the containment tank.

Ultimately, the present invention provides a complete system with the containment tank and diverter vault. The tank and vault materials are constructed in either fiberglass, steel or concrete. The tank/vault materials are non-permeable and chemical-proof. The present invention provides a compact configuration and a relatively small footprint. The present invention is very easy to install. Ultimately, the present invention can be obtained from a single supplier instead of multiple suppliers. The size of the present invention, along with the single source for the present invention, serves to reduce freight costs. The present invention can be utilized on either below-ground or above-ground conditions. The size of the tanks can range from 500 to 10,000 gallons. The present invention provides a control system with high-level leak detection. The covers associated with the risers of the present invention provide watertight, pressure, and traffic-duty access covers. The present invention provides easy installation and maintenance. The present invention as an integrated diverter valve system. Each of the compartments of the present invention has non-porous surfaces for easy cleaning The result of the present invention is that it maximizes utilization of rinse areas by allowing sewer discharge of non-hazardous rinse activities. The present invention can further include sampling stations, discharge pumps, pump ports, discharge sewer valves, remote nurse station alarms, and HEPA event filtration.

The present invention has various control system operation modes. In a "Normal Mode" wastewater is directed to the sanitary sewer. Rinse water is not used for patient decontamination rinse activities. It is allowed to drain into the sanitary sewer. All wastewater from rinse activities will drain via the floor drain to the sanitary sewer.

Another mode is the patient decontamination rinse mode. The activation of the "Patient Decontamination Rinse Mode" would occur only when the water is actually being used for patient decontamination rinse activities. The wastewater may contain hazardous substances and should not enter the sewer. Instead, the wastewater is directed to the containment tank. All wastewater from rinse activities will drain via the floor drain to the containment tank. Wastewater is stored there until proper disposal occurs by professional wastewater service companies. The activation of this "Patient Decontamination Rinse Mode" can be automatic (based on fresh water flow) or manual (based on user activation). When activated, a signal is sent to the system management panel where the diverter valve changes position and wastewater flows to the containment tank. All fluids are retained in the containment tank. The diverter valve will remain in this state until the diverter valve is directed to return to the normal position (i.e. draining to the sewer).

The present invention also includes a "Manual Mode". In this "Manual Mode", the user can choose wastewater drainage to the sewer or to the wastewater tank. There can also be a "Tank Pump Mode". This allows the user to activate the tank pump to discharge wastewater from the tank to the sanitary sewer. Wastewater that has been tested to ensure that no hazardous contaminants exist that can be disposed safely into the sanitary sewer.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A decontamination rinse wastewater management system for use with a shower facility, the decontamination rinse wastewater management system comprising:

a containment assembly having a first compartment and a second compartment integrally connected together, the first compartment being of a double-wall construction in which an inner wall is positioned interior of an outer wall so as to define an annulus therebetween;

a diverter valve having an inlet and a first outlet and a second outlet, the first outlet being directed to the first compartment, the inlet of said diverter valve adapted to receive wastewater from the shower facility, the second outlet of said diverter valve adapted to be connected to a sewer, said diverter valve being actuatable so as to move to a first position wherein wastewater from the shower facility is directed to the first compartment and to move to a second position wherein wastewater from the shower facility is directed to the sewer, said diverter valve being positioned in the second compartment of said containment assembly;

a controller connected to said diverter valve so as to move said diverter valve between the first and second positions; and a leak detector positioned in the annulus between the inner wall and the outer wall of the first compartment, said leak detector adapted to sense a presence of a liquid in the annulus.

2. The decontamination rinse wastewater management system of claim 1, said first compartment having a single wall extending in a generally cylindrical configuration, the first outlet of said diverter valve extending, through the single wall into an interior of the first compartment.

3. The decontamination rinse wastewater management system of claim 1, said diverter valve comprising:

a valve body:

a first pipe connected to said valve body and extending in a direction toward the shower facility, said first pipe being the inlet of said diverter valve or being connected to the inlet of said diverter valve;

a second pipe connected to said valve body and extending of outwardly of the second compartment, said second pipe adapted to be connected to the sewer; and a third pipe connected to said valve body and extending outwardly of the second compartment and into the first compartment, said third pipe adapted to discharge rinse water from the shower facility into the first compartment.

4. The decontamination rinse wastewater management system of claim 3, the second compartment having a sump pump on an interior thereof, the sump pump being connected to the second pipe, the sump pump adapted the pump a liquid in the second compartment toward the sewer.

5. The decontamination rinse wastewater management system of claim 1, said containment assembly being formed of a material selected from the group consisting of fiberglass, steel and concrete.

6. The decontamination rinse wastewater management system of claim 1, further comprising:

a level sensor affixed within the first compartment, said level sensor adapted to detect a level of the wastewater in an interior of the first compartment;

a water sensor positioned in an interior of the second compartment, said water sensor adapted to sense a presence of water in the second compartment; and an electrical junction box connected to said leak detector and to said level sensor and to said water sensor, said electrical junction box being in communication with said controller.

7. A decontamination rinse wastewater management system for use with a shower facility, the decontamination rinse wastewater management system comprising:

a containment assembly having a first compartment and a second compartment integrally connected together;

a diverter valve having an inlet and a first outlet and a second outlet, the first outlet being directed to the first compartment, the inlet of said diverter valve adapted to receive wastewater from the shower facility, the second outlet of said diverter valve adapted to be connected to a sewer, said diverter valve being actuatable so as to move to a first position wherein wastewater from the shower facility is directed to the first compartment and to move to a second position wherein wastewater from the shower facility is directed to the sewer, said diverter valve being positioned in the second compartment of said containment assembly; and a controller connected to said diverter valve so as to a move said diverter valve between the first and second positions, the first compartment having a first riser extending from an upper portion thereof, the second compartment having a second riser extending from an upper portion thereof, each of the first and second risers adapted to allow access to an interior of the first and second compartments, respectively.

8. A wastewater management system comprising:

a shower facility having a drain, the drain adapted to pass water from the shower facility outwardly of the shower facility;

a containment assembly having a first compartment and a second compartment integrally connected together;

a diverter valve having an inlet and a first outlet and a second outlet, the first outlet being directed to the first compartment, the inlet of said diverter valve connected to the drain of said shower facility so as to receive the water from said shower facility, the second outlet of said diverter valve adapted to be connected to a sewer, said diverter valve being actuatable so as to move to a first position wherein water from the shower facility is directed to the first compartment and to move to a second position wherein water from the shower facility is directed to the sewer, said diverter valve being positioned in the second compartment, said diverter valve comprising:

a valve body;

a first pipe connected to said valve body and extending in a direction toward said shower facility, said first pipe being connected to the drain of said shower facility, said first pipe being connected to the inlet of said diverter valve or being the inlet of said diverter valve;

a second pipe connected to said valve body and extending outwardly of the second compartment, said second pipe adapted to be connected to the sewer; and a third pipe connected to said valve body and extending outwardly of the second compartment and into the first compartment, said third pipe adapted to discharge the water from said shower facility into the first compartment , the second compartment having a sump pump on an interior thereof, the sump pump being connected to the second pipe, the sump pump adapted to pump a liquid in the second compartment toward the sewer; and a controller connected to said diverter valve so as to move said diverter valve between the first and second positions.

9. The wastewater management system of claim 8, the first compartment having a single wall extending in a generally cylindrical configuration, the first outlet of said diverter valve extending through the single wall into an interior of the first compartment.

10. The wastewater management system of claim 9, the first compartment being of a double wall construction in which an inner wall is positioned interior of an outer wall so as to define an annulus therebetween.

11. The wastewater management system of claim 10, further comprising:

a leak detector positioned in the annulus between the inner wall and the outer wall of the first compartment, said leak detector adapted to sense a presence of a liquid in the annulus.

12. The wastewater management system of claim 11, further comprising:

a level sensor affixed within the first compartment, said level sensor adapted to detect a level of the water in an interior of the first compartment;

a water sensor positioned in an interior of the second compartment, said water sensor adapted to sense a presence of water in the second compartment; and an electrical junction box connected to said leak detector and to said level sensor and to said water sensor, said electrical junction box being in communication with said controller.

13. The wastewater management system of claim 8, the first compartment having a first riser extending from an upper portion thereof, the second compartment having a second riser extending from an upper portion thereof, each of the first and second risers adapted to allow access to air interior of the first and second compartments respectively.

14. The wastewater management system of claim 8, said containment assembly being formed of a material selected from the group consisting of fiberglass, steel and concrete.

* * * * *